US007302888B2

(12) United States Patent
Huang et al.

(10) Patent No.: US 7,302,888 B2
(45) Date of Patent: Dec. 4, 2007

(54) METHOD AND APPARATUS FOR ROTATIONAL MEDIA PRINTING

(75) Inventors: Xiaoxi Huang, Singapore (SG); Michael Nordlund, Singapore (SG); Manish Agarwal, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 96 days.

(21) Appl. No.: 10/944,300

(22) Filed: Sep. 17, 2004

(65) Prior Publication Data

US 2006/0060094 A1 Mar. 23, 2006

(51) Int. Cl.
*B41F 17/00* (2006.01)

(52) U.S. Cl. ..... 101/35; 400/70; 347/5

(58) Field of Classification Search ..... 399/384
See application file for complete search history.

(56) References Cited

U.S. PATENT DOCUMENTS 5,542,768 A * 8/1996 Rother et al. ..... 400/120.16
5,795,395 A * 8/1998 Ben-Matitayhu et al. ... 118/712
5,927,208 A * 7/1999 Hagstrom et al. ..... 101/486
5,967,676 A * 10/1999 Cutler et al. ..... 400/70
6,041,703 A * 3/2000 Salisbury et al. ..... 101/37
6,123,020 A * 9/2000 Wolfer et al. ..... 101/35
6,202,550 B1 * 3/2001 Lee et al. ..... 101/38.1
6,264,295 B1 * 7/2001 Bradshaw et al. ..... 347/2
6,536,345 B1 * 3/2003 Young ..... 101/485
6,543,346 B2 * 4/2003 Rodefeld ..... 101/35
6,771,297 B2 * 8/2004 Bronson ..... 347/224
6,783,225 B2 * 8/2004 Burns et al. ..... 347/101
6,827,509 B2 * 12/2004 Suden et al. ..... 400/120.1
2001/0035886 A1 * 11/2001 Bradshaw et al. ..... 347/2
2005/0169684 A1 * 8/2005 Mochizuki ..... 400/23

FOREIGN PATENT DOCUMENTS

JP 2003072154 A * 3/2003

* cited by examiner

*Primary Examiner*—Jill E. Culler

(57) ABSTRACT

An apparatus for use in printing to a rotational media having a surface to be printed to and being rotatable about an axis extending away from the surface is provided. The apparatus includes an engaging arrangement to engage the rotational media so as to impart controlled rotational movement thereto about the axis. The engaging arrangement is configured to be coupled to printer gearing on a printer, such that rotation of the printer gearing on the printer causes rotation of the rotational media when engaged on the engaging arrangement.

6 Claims, 13 Drawing Sheets

1st Swath

2nd Swath

3rd Swath

METHOD AND APPARATUS FOR ROTATIONAL MEDIA PRINTING

FIELD OF THE INVENTION

The present invention relates to printers. In particular, the invention relates to printing to rotational media, such as, but not limited to, Compact Discs.

BACKGROUND OF THE INVENTION

Inkjet printers generally have a printhead, from which the ink for printing is expelled onto a medium. The printhead (or "pen" as it is sometimes known) generally has a large number of nozzles that expel ink onto the medium with a very high degree of precision.

The printhead in a printer is generally much smaller than the medium to be printed on. The medium is therefore advanced past the printhead in a first direction (in a so-called media-feeding direction). In order to print to areas of the media perpendicular to the media-feeding direction, the printhead itself is translated across the medium in a direction perpendicular to the media-feeding direction. The width of a strip of medium that can be printed to on one translation of the printhead is called a swath, which corresponds to the height of the printhead. Therefore, substantially the whole of a two dimensional surface can be printed using one or more swaths by perpendicular advancement of the medium to each swath after completion of each swath. Thus, printing can be achieved by using a printhead, which has a maximum printhead height that is less than the dimension of the medium in the first direction. In order to ensure that the image to be printed is accurately produced, the changing positioning of the printhead relative to the medium must be highly accurate.

When regularly shaped paper is the medium pinch rollers can control the advancement of the medium accurately. However, accurate positioning of some types of media is not possible using such pinch rollers. Misalignment of the media can cause printable ink to be placed on the printer parts. Additionally, uneven loading of the pinching rollers will cause inconsistent pen to paper spacing leading to reduction of consistent drop placement on the paper and poor print quality.

SUMMARY OF THE INVENTION

In brief, the invention provides an apparatus for use in printing to a rotational media having a surface to be printed to and being rotatable about an axis extending away from the surface. The apparatus includes an engaging arrangement to engage the rotational media so as to impart controlled rotational movement thereto about the axis. The engaging arrangement is configured to be coupled to printer gearing on a printer, such that rotation of the printer gearing on the printer causes rotation of the rotational media when engaged on the engaging arrangement.

BRIEF DESCRIPTION OF THE DRAWINGS

Embodiments of the invention will now be described, purely by way of example, with reference to the accompanying drawings, in which.

DETAILED DESCRIPTION OF PREFERRED EMBODIMENTS OF THE INVENTION

Figure 1A:
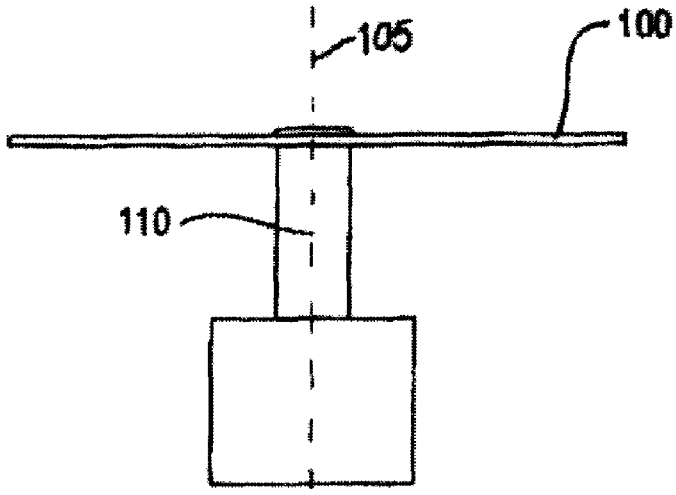
FIG. 1*a* shows an apparatus for use in rotational media printing in a printer according to an embodiment of the invention.

FIG. 1*a* shows an apparatus for use in printing to a rotational media 100 having a surface to be printed to and being rotatable about an axis 105 extending away from the surface. The apparatus includes an engaging arrangement 110 to engage a rotational media 100 so as to impart controlled rotational movement thereto about the axis 105. The engaging arrangement 110 is configured to be coupled to printer gearing on a printer, such that rotation of the printer gearing on the printer causes rotation of the rotational media 100 when engaged on the engaging arrangement 110.

Figure 1B:
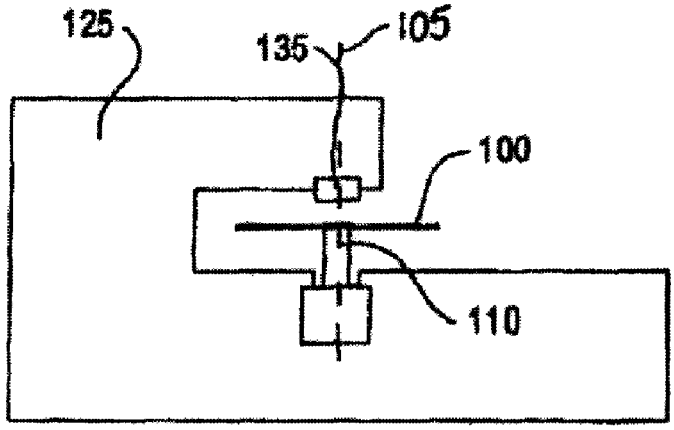
FIG. 1*b* shows a printer for rotational media printing according to an embodiment of the invention.

FIG. 1*b* shows a printer 125. The printer 125 includes a printhead 135 for printing to a rotatable media 100 having a surface to be printed to and being rotatable about an axis 105 extending away from the surface. The printhead 135 translates in a first direction and has a height in a second direction, perpendicular to the first direction. An engaging arrangement 110 is provided to engage the rotatable media 100 to impart controlled rotation thereto relative to the printhead 135 about the axis 105, in order to allow printing by the printhead 135 to a region of the surface of the rotatable media 100 extending in the second direction by a greater amount than the height of the printhead 135.

Figure 1C:
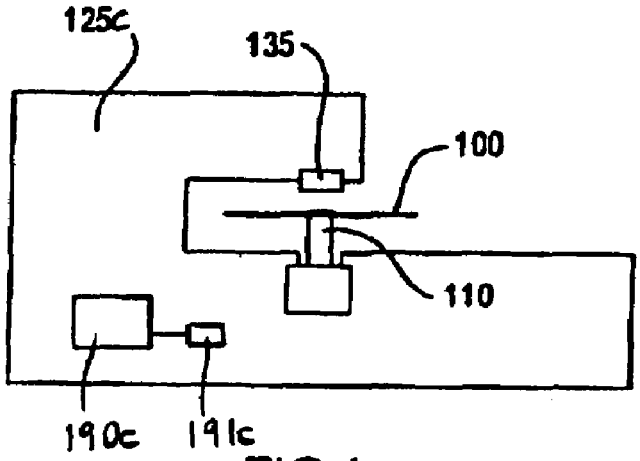
FIG. 1*c* shows a printer for rotational media printing according to an embodiment of the invention.

FIG. 1*c* shows a printer 125*c*. Elements bearing the same reference number as the printer 125 shown in FIG. 1*b* are the same as those described with reference to FIG. 1*b*. The printer 125*c* shown in FIG. 1*c* also includes a storage medium 190*c* for storing processor readable code to control a processor 191*c*, which storage medium 190*c* and processor 191*c* can be used in the methods described with regard to FIGS. 3*a* to 3*d* described below. The storage medium 190*c* is RAM, but could alternatively be a fixed or removable disk drive.

Figure 1D:
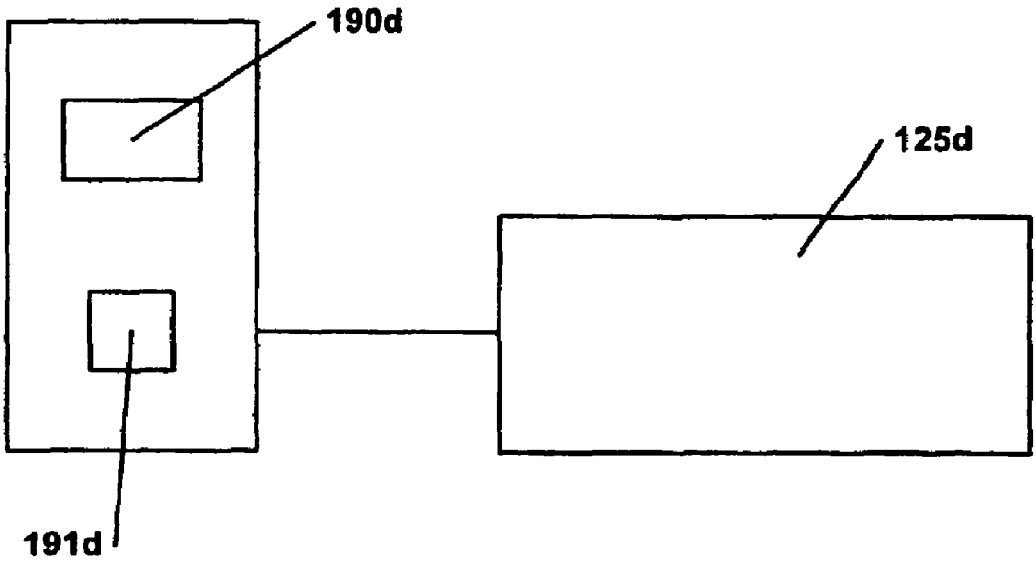
FIG. 1*d* shows a system for use in rotational media printing according to an embodiment of the invention.

In the embodiment shown in FIG. 1*c*, the storage medium 190*c* is housed within the printer 125*c*. However, in the embodiment shown of the invention shown in FIG. 1*d*, a storage medium 191*d* is provided separate from the printer 125*d*. Once again the storage medium 190*d* is for storing processor readable code to control a processor 191*d*, which storage medium 190*d* and processor 191*d* can be used in the methods described with regard to FIGS. 3*a* to 3*d* described below. The storage medium may be a software disc, such as a CD-Rom or the like, which, before use, may be provided with the printer when purchased, and loaded onto a computer including a processor, which will be controlled by the processor readable code held on the storage medium.

Figure 2A:
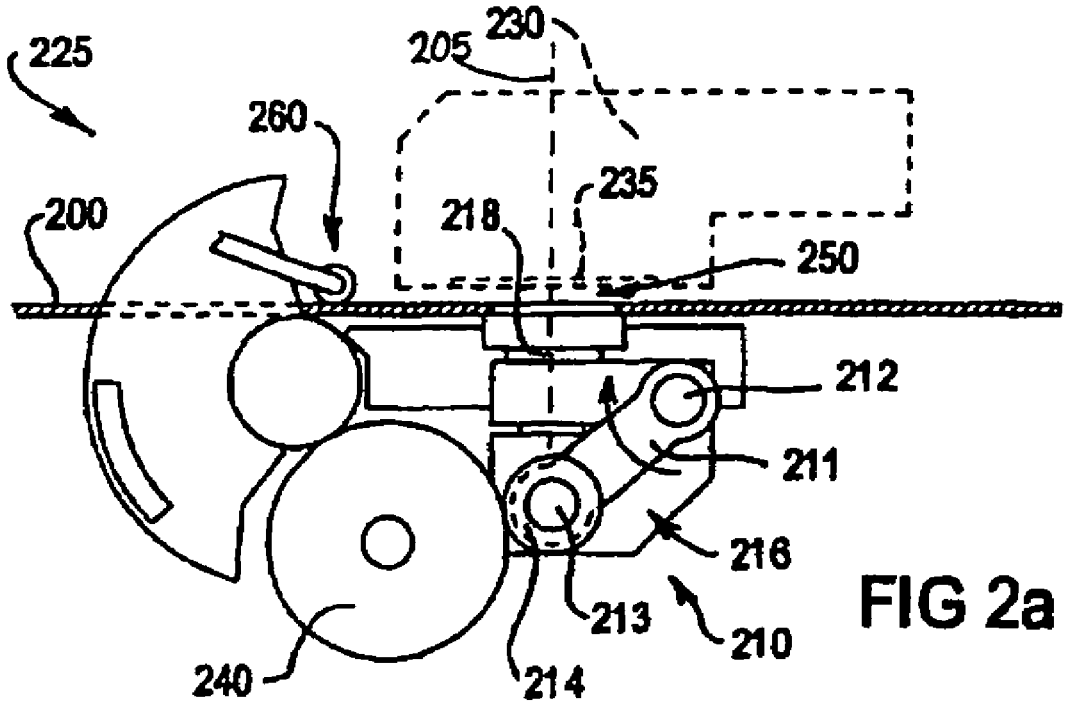
FIG. 2*a* shows the printer of FIG. 1*b*, with the apparatus in a position for printing to a rotational media, in accordance with an embodiment of the invention.

FIG. 2*a* shows a side view of a part of a printer 225 having an engaging arrangement 210 mounted thereon. The printer 225 has a carriage 230, which carries a printhead 235, or pen, for printing to media 200 having a surface to be printed to and an axis 205 about which it can be rotated. The rotational media is one that can be rotated about an axis extending away of the plane of a surface of the rotational media to be printed to, such as axis 205.

The printhead 235 is moveable in a first direction, and has a height in a second direction perpendicular to that first direction, and substantially parallel to the surface of the media 200 to be printed to. The printhead 235 outputs ink from a side of the printhead 235 extending in the second direction. The printer 225 also has line feed motor gearing 240, which is arranged to engage with non-rotatable media to be printed to feed it through a print zone 250, past the carriage 230, in the second direction. The printer 225 has a pinch roller assembly 260, which ensures that media fed to the print zone 250 from a storage tray (not shown) are positioned correctly within the print zone 250.

The engaging arrangement 210 is selectively engageable with existing gearing in the printer 225, in the present embodiment the line feed motor gearing 240. The engaging arrangement 210 includes a lever arm 211. A first end of the lever arm 211 is pivotably attached to the printer 225 on a pivot shaft 212. A second end, opposite the first end, of the lever arm 211 is mounted an apparatus shaft 213. An apparatus driving gear 214 is mounted on the apparatus shaft 213.

Figure 2B:
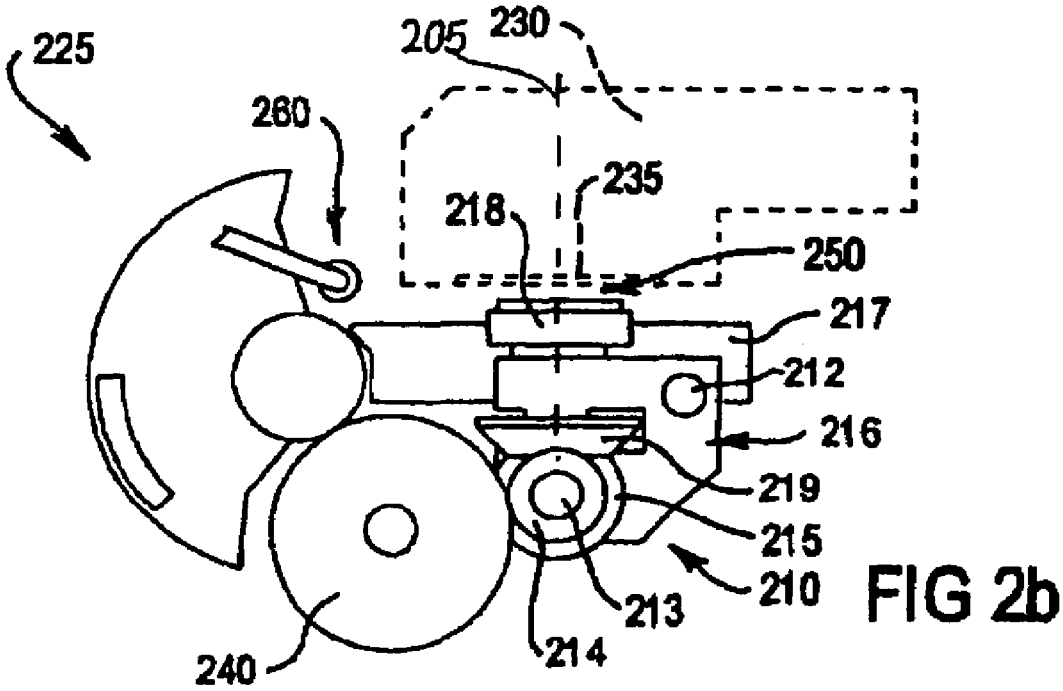
FIG. 2*b* shows a printer including an apparatus according to an embodiment of the invention in a retracted position in a printer.

FIG. 2*b* shows a side view of a part of a printer corresponding to FIG. 2*a*, with internal parts of the engaging arrangement 210 shown. A first bevel gear 215 is mounted on the apparatus shaft 213, which co-rotates with the apparatus driving gear 214. A spindle housing 216 is mounted on both the pivot and apparatus shafts 212, 213 via a platen rib 217. A spindle 218 is rotatably mounted in the spindle housing 216 substantially at right angles to the apparatus shaft 213. The spindle housing 216 also has a second bevel gear 219, which is mounted on the spindle 218, so as to engage the first bevel gear 215 mounted on the apparatus shaft 213, and transmit rotation of the apparatus shaft 213 onto the spindle 218.

When the apparatus is fitted to a printer 225 having a carriage and rotational media which is thicker than normal media is to be printed to, the carriage 230 is raised so that the printhead 235 is in a position to print to rotational media. The pinch roller assembly 260 is adjusted to give a vertical clearance between the pinch roller assembly 260 and the line feed rollers. The clearance is sufficient for a rotational media to be placed between the two parts.

The rotational media to be printed on can then be loaded into the print zone 250.

The engagement is such that rotation of the spindle 218 causes rotation of the rotational media about an axis extending away from the plane of a surface of the rotational media to be printed to, and the media and spindle 218 are rotationally engaged. When a rotational media is in position in the print zone 250, the spindle 218 is engaged with the media and the line feed motor gearing 240, the media is printed to, as described below. The plane of rotation of the rotational media is substantially parallel to the surface of the rotational media to be printed on and, therefore, substantially parallel to the height of the printhead 235, and substantially parallel to the direction in which the printhead translates, as discussed in relation to FIG. 2*a* above.

Figure 2C:
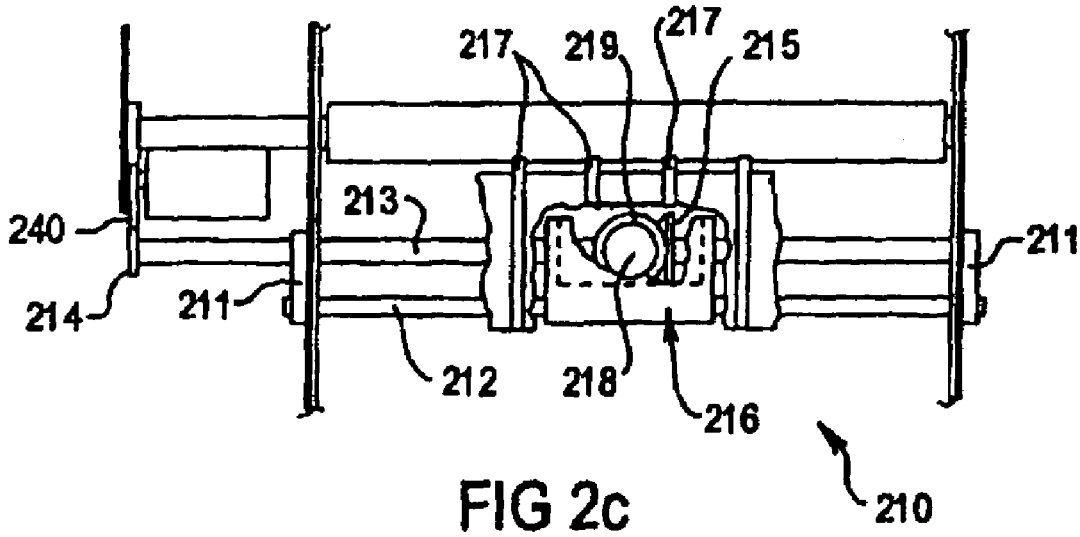
FIG. 2*c* and FIG. 2*d* show a detail of the engagement of the gearing of the apparatus with the gearing of the printer, in accordance with an embodiment of the invention.

FIG. 2*c* shows a plan view of a part of the printer of FIGS. 2*a* and 2*b*. FIG. 2*c* shows the engaging arrangement 210 with the spindle housing 216 partially cut away to show the internal parts thereof. A plurality of platen ribs 217 are shown, mounting the spindle housing 216 onto the pivot and apparatus shafts 212, 213. One lever arm 211 is provided on each side of the engaging arrangement 210 on one side of the printer, the apparatus shaft 213 extends beyond the lever arm 211 on that side, to allow the apparatus driving gear 214 to engage with the line feed motor gearing 240. When the engaging arrangement 210 is in a utility position, as the line feed motor gearing 240 rotates, so does the apparatus shaft 213, due to engagement with the apparatus driving gear 214. The rotation of the apparatus shaft 213 causes the first bevel gear 215, mounted on the apparatus shaft 213, to rotate.

The second bevel gear 219 rotates with the first bevel gear 215, causing the spindle 218 to rotate. In this way, the amount and direction of rotation of the spindle 218 can be controlled using the existing gearing (line feed motor gearing 240) of the printer. The gear ratio of this gear train is equal to the gear ratio from line feed motor gear to line feed gear on the printer. Thus, the speed of rotation of the spindle 218 is equal to the speed of rotation of a line feed roller of the printer. This means that the spindle movement can make use of the line feed roller servo architecture for closed loop servo control. The spindle 218 rotates the rotational media about a central portion of the rotational media.

Once printing is finished, the spindle 218 is moved to a retracted position underneath the print zone and the engaging arrangement 210 is disengaged from the line feed motor gearing 240 so that the engaging arrangement 210 does not interfere in printing to other, non-rotational, media by the printhead.

Figure 2D:
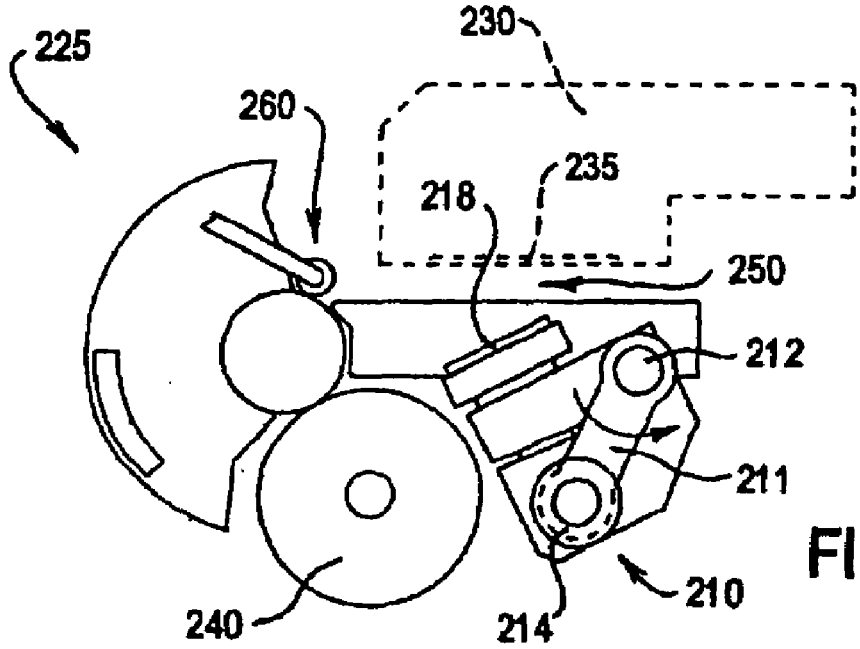

FIG. 2*d* shows the system of FIG. 2*a*, when the engaging arrangement 210 is in the retracted position. In order to disengage the spindle 218 of the engaging arrangement 210, the lever arm 211 is rotated away from the line feed motor gearing 240, so that the apparatus driving gear 214 is disengaged from the line feed motor gearing 240. When the apparatus driving gear 214 is disengaged with the line feed motor gearing, as shown in FIG. 2*d*, the printer will assume normal line feed advance and printing behavior. In order to reengage the spindle 218, the lever arm 211 is rotated about the pivot shaft 212 towards the line feed motor gearing 240, to engage the apparatus driving gear 214 and, at the same time, raise the spindle 218 into the utility position to receive rotational media.

The lever arm 211 can be linked with a mechanism [not shown] that controls the positioning of the pinch roller 260, which can either be manually positioned, or may be driven by an actuator. In such a way, the pinch roller 260 will be resumed to the normal paper printing position when the apparatus is retracted.

The engaging arrangement 210 may be removable from the printer, and may be mountable on standard printers, as well as or instead of being retractable into the printer. Alternatively, the printer may be a specialized rotational media printer (not shown), in which the engaging arrangement and coupling gearing are not retractable.

Figure 3A:
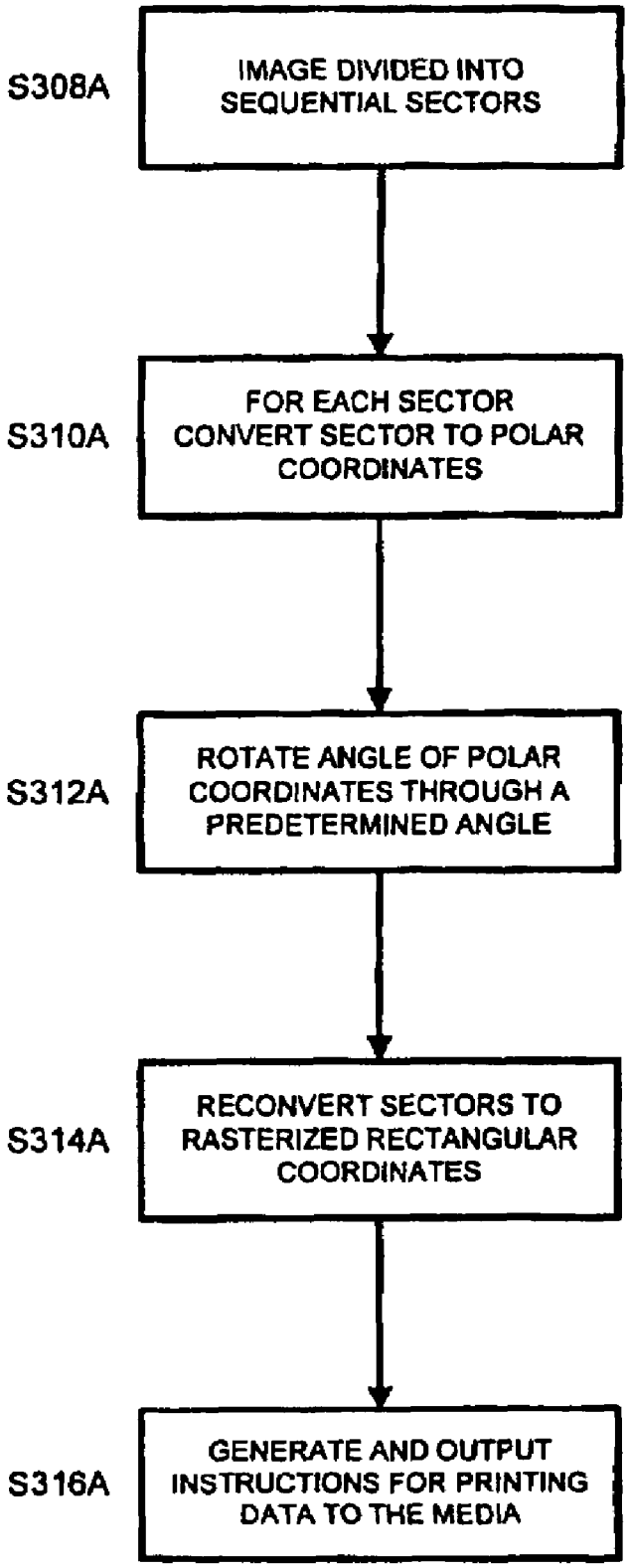
FIG. 3*a* shows a flow diagram for processing an image to be printed on a rotational media according to an embodiment of the invention.

As shown in FIG. 3*a*, an embodiment of the invention provides a method of printing to a rotational media by a printer. The method includes processing data representing an image to be printed, the data including image data representing the image as pixels in a rectangular coordinate system. The processing divides the image into a plurality of sectors at S308A. The processing also converts the pixel locations of the plurality of sectors of the image into polar coordinates at S310A. The processing rotates the polar coordinates for each sector by predetermined respective angles at S312A. The processing also reconverts the pixel locations of said sectors into rasterized rectangular coordinates according to the rectangular coordinate system at S314A. Data representing instructions to print the sectors to the media, including said reconverted data is generated for output at S316A.

Figure 3B:
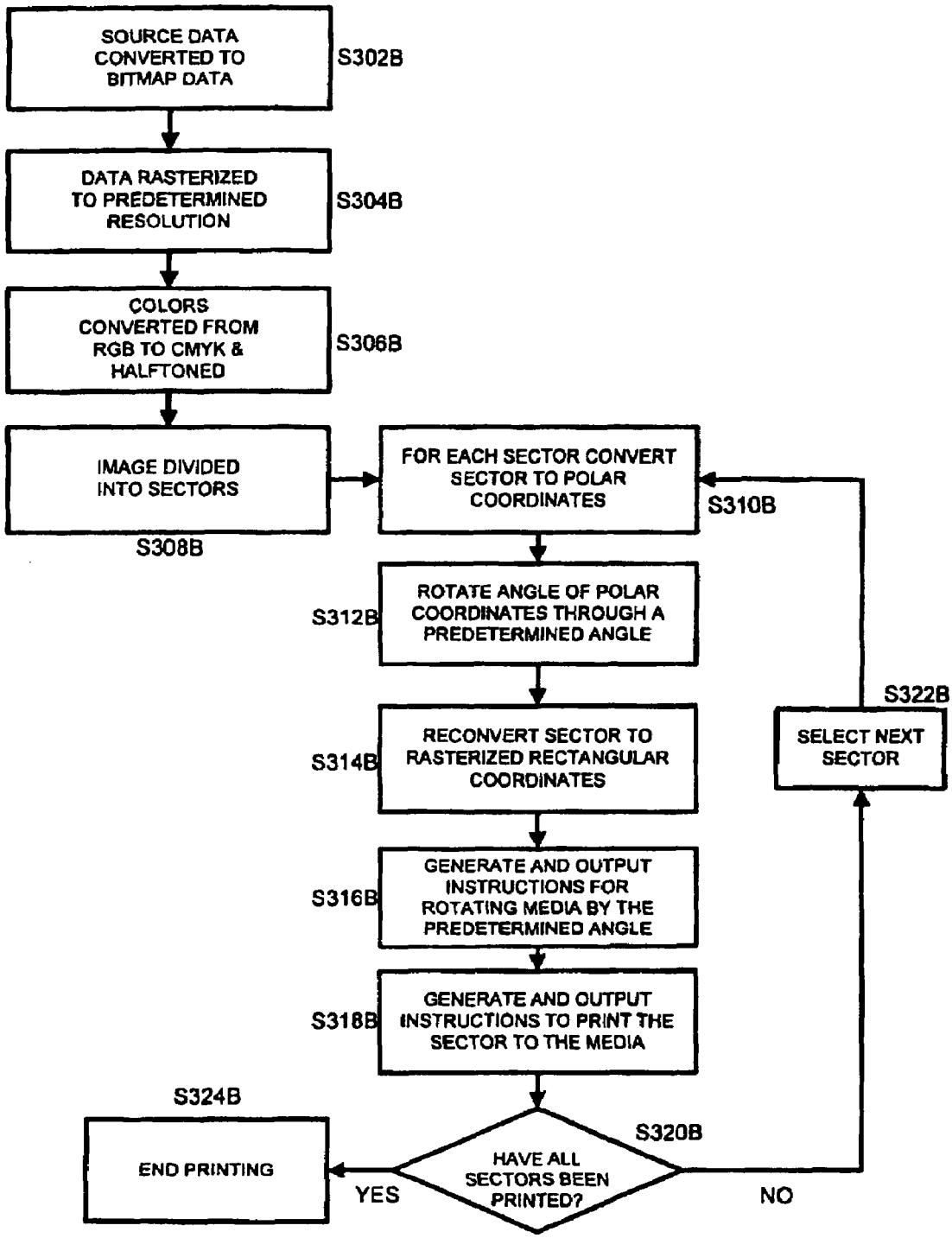
FIG. 3*b* shows a flow diagram for processing an image to be printed with singular predetermined sectors on a rotational media according to an embodiment of the invention.

FIG. 3*b* shows a more detailed schematic flow diagram for preparing an image to be printed on the rotational media according to an embodiment of the invention. At S302B, the data representing the image is converted from its existing format into bitmap format if required. This step may be achieved within the computer software producing the image, either under user control, or automatically, or may be achieved within the printer. The data in the bitmap image includes image size, resolution and color space (e.g. 5"×5", 300 d.p.i, 8 bit RGB color). At S304B, the bitmap image data is rasterized, that is, it is made to a certain resolution having a rectangular coordinate system with a predetermined horizontal and vertical spacing, the spacings being independently adjustable.

In an embodiment, the image is also made to fit a rotational media to be printed to. If the image is a different shape to the rotational media, the image can be re-sized, cropped, or stretched in one direction relative to another using established algorithms such as bi-cubic or linear interpolation techniques. However, regardless of the application of any combination of these techniques, any part of the final image that is beyond the limits of the printable area of the rotational media will preferably be cropped to prevent printing on anything other than the rotational media.

At S306B the colors are color mapped from source RGB to printer RGB data using either internal or externally applied mappings. The color data is then halftoned to CMYK data. Of course, if the data received is already in CMYK format, then S306B can be omitted.

At S308B the image is divided into sectors. The center point of each of the sectors is the center of the image, which corresponds to the center of the rotational media.

In the present embodiment, each sector subtends the same angle, and the chord subtended by each sector is the angle at which the maximum width of the sector corresponds to the swath height of the printer pen. This is because the pen will not be able to print an entire sector if the subtended angle is greater than this maximum angle. The sectors can be made smaller than the maximum swath height, and do not need to subtend the same angle, as desired.

In the present embodiment, the sectors are processed sequentially. At S310B the rectangular coordinates of a first sector are converted into a polar coordinate system, in which each pixel location is converted into a rotation angle from a predetermined zero angle, which in the present embodiment is the same as the horizontal axis of the rasterized image, and the axis of movement of the printhead, and a radius value from the origin of the polar coordinates, which, in the present embodiment, is the center of the image, and the point at which all the sectors meet.

Depending on the type of rotational media, a central circle of the image may be removed, corresponding to the location of a non-printable region of the rotational media. For example, the central location of a compact disc contains a hole, and is therefore unprintable and requires the image data in this location to be removed. This removal of data may occur either at the initial rendering stage, which sets all limiting boundaries for printing, or will occur in the printer during the formation of each printing swath. The swath data will be empty for those regions identified as non-printable, pending the recognition of the type of rotational media, or by optical scanning of the installed media for the printer to define printable boundaries. For the example of a compact disc type of rotational media, the printable sectors then become a series of divisions of a ring image centered about the center of the image.

At S312B the angle of the polar coordinate of each of the pixels of the first sector in the polar coordinates is rotated by an angle, the angle being the angle set to locate the second sector so that, depending on the overlap desired with the first sector, it's maximum angle would be equal to the angle of the sector, with the zero angle line of the polar coordinate system bisecting the sector.

Then at S314B the polar coordinates are reconverted to rasterized rectangular coordinates using the same coordinate system as the original image. The sector is now in rectangular coordinates to be printed by the printer. However, the rotational media must be rotated at S316B by the same angle as the sector was rotated, so that the reconverted sector is printed at S318B to the correct portion of the rotational media. If the method of printing involves multiple passes of the printhead over the same location on the media, then the angle of rotation will be some fraction which depends on the required number of passes of the printhead. For example, if the ink was to be printed over two cumulative sweeps, then the media may rotate only half the maximum angle for each rotation in order for the printhead to pass twice over the same area on the rotational media.

The process of S310B to S318B is then repeated until all of the sectors have been printed. The angle of the sectors may be chosen to be all the same, as a factor of 360° ($2\pi$ Radians), in order to ensure an exact number of sectors are printed to the media. In one embodiment, the angle subtended by each sector is 15°, and the rotational media is rotated 23 times, once after each sector is printed.

The printer itself may receive the image data before or after any one of the processes above in relation to FIG. 3*b* depending on whether the image processing is done in the host computer, or in the printer.

Figure 3C:
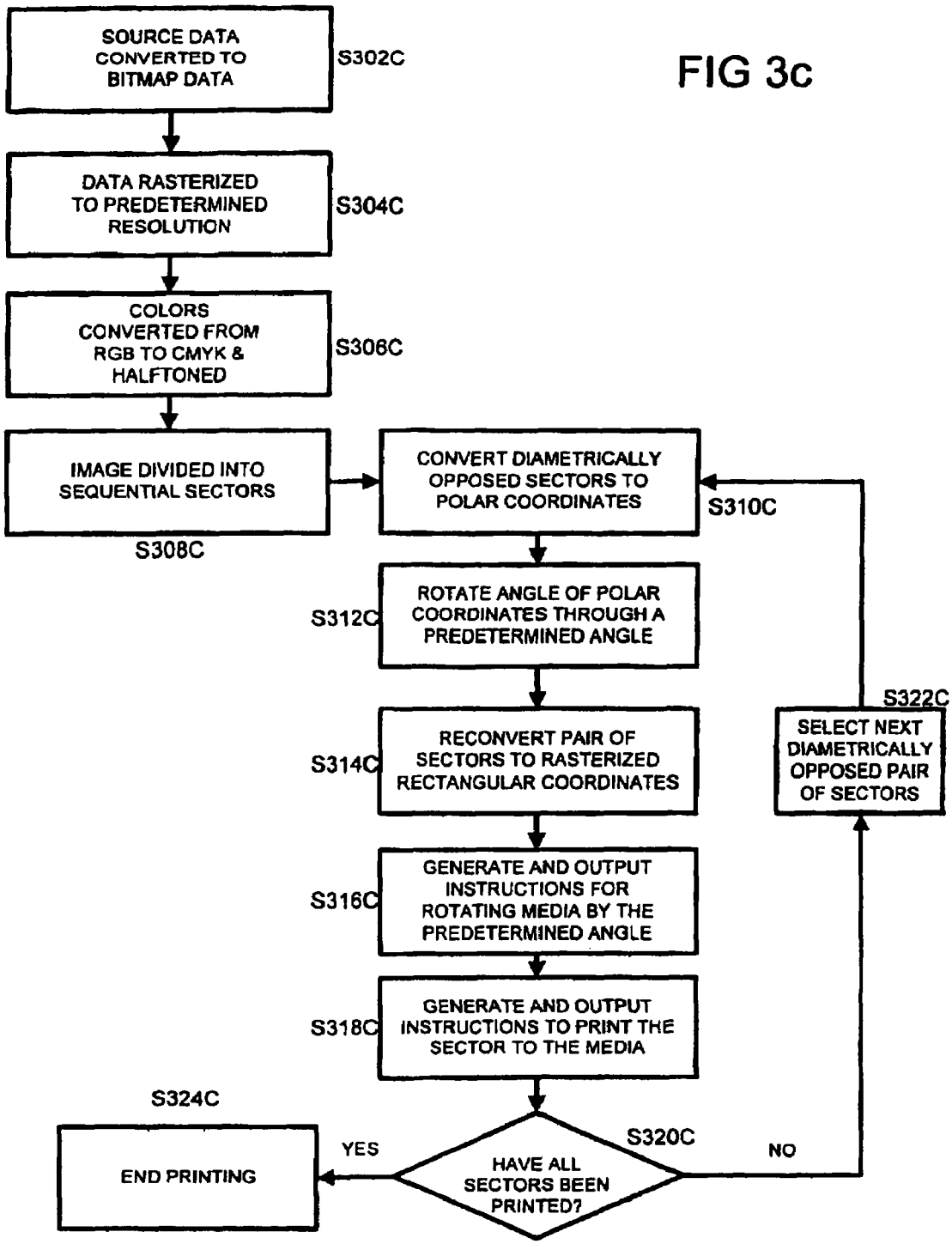
FIG. 3*c* shows a flow diagram for processing an image to be printed with diametrically opposed pairs or sectors on a rotational media according to an embodiment of the invention.

An alternative embodiment is shown in FIG. 3*c*. This process differs from that shown in FIG. 3*b* in that the sectors are process in diametrically opposed pairs. Therefore, in S310C to S314C, pairs of diametrically opposed sectors are converted into polar coordinates, in the same manner as above, rotated through a predetermined angle, and reconverted as described above. The rotational media is rotated, as described above, at S316C, and then each pair of sectors is printed after it is processed at S318C.

Figure 3D:
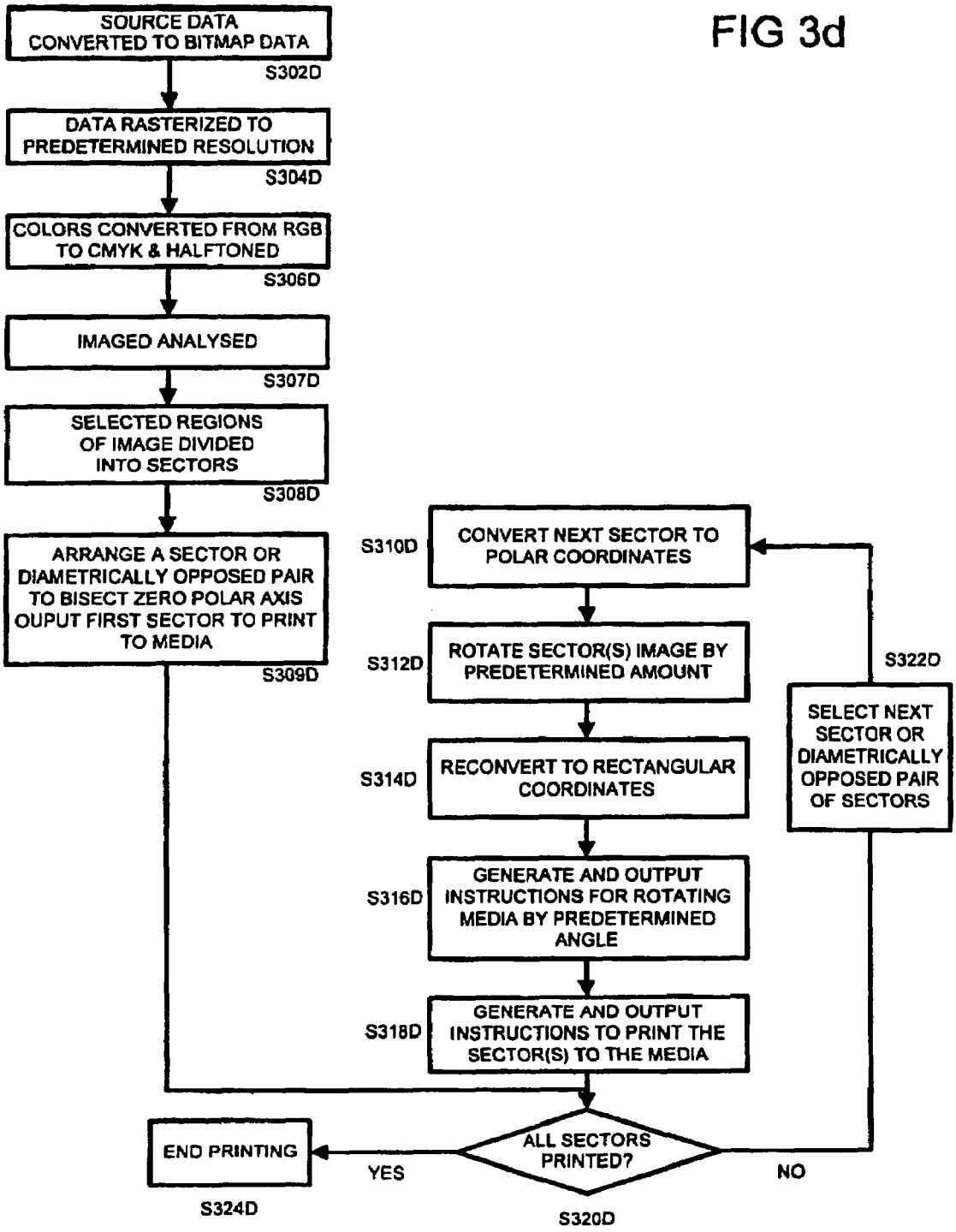
FIG. 3*d* shows a flow diagram for processing an image to be printed with selected sectors on a rotational media according to an embodiment of the invention.

In an embodiment, shown in FIG. 3*d*, which can be added to both embodiments described above, S302D to S306D are as described above. However, an additional step is included at S307D, where the image is analyzed to determine whether the image will cover the entire surface of the media, or whether the image can be so divided into sectors that some sectors contain no image data. Then at S308D, the image is divided into sectors each containing image data. In order to minimize the total printing time, the processing of the sector printing sequence fits the non-empty image data optimally into the fewest number of sectors in order to minimize the number of printing swaths. Therefore, during the printing process, it will be known where the rotational media needs to be rotated to print each sector, even if successive rotations are not all of equal magnitude. Areas that do not contain data are not included in the processing. The angle at which each sector is arranged with regard to a reference angle is determined.

Additionally, an extra step is included before S310D. At S309D, whether or not the sector, or pair of sectors, to be processed bisects the zero angle of the polar coordinates is determined. The image can be rotated during processing at S307D, to ensure that a pair of selected sectors does bisect the zero angle of the polar coordinates. For sectors that are bisected by the zero angle of the polar coordinates, conversion to polar coordinates, rotation and reconversion (S310D to S316D) is omitted, as the angle of rotation that would need to be applied would be zero, and the sector, or pair of sectors is ready to be output for printing (at S318D) without any further processing. Once that sector, or pair of sectors, is output, each remaining sector, or pair of sectors, is processed in S310D to S324D, as described above.

In the previous embodiments, the sectors have been processed in series. The sectors could also be processed all at once, with all sectors or pairs of sectors being processed together, with considerations given to ensure the boundaries of adjacent sectors are pre-processed for image data continuity across the boundaries once the individual sectors are all printed.

Figure 4A:
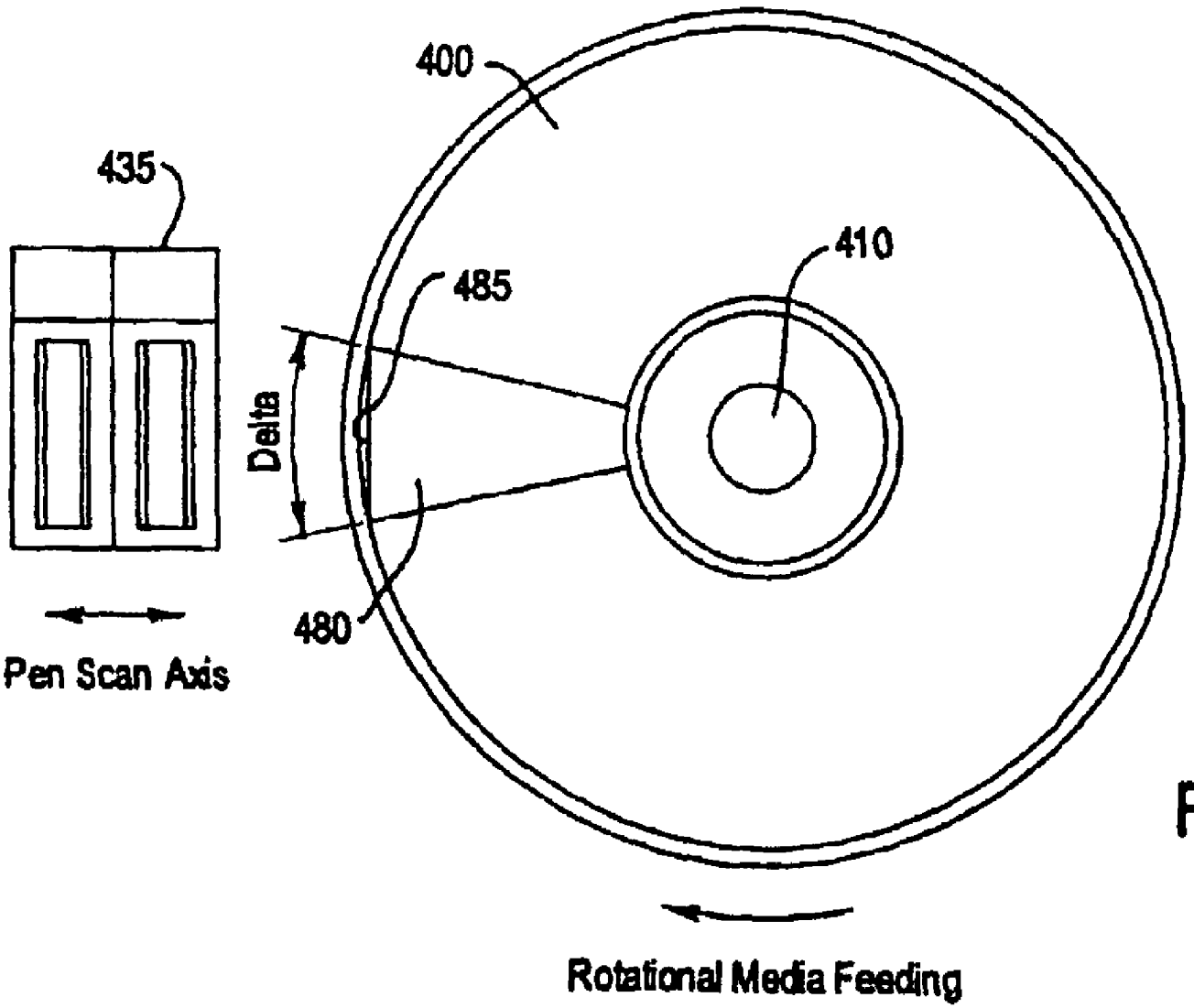
FIG. 4*a* shows a plan view of a rotational media being printed on according to an embodiment of the invention following the flow diagram of FIG. 3*b;*

FIG. 4*a* shows a surface of a rotational media to be printed on, a single sector 480 of the media already having received a part of the image to be applied, according to an embodiment. The figure shows a printhead, or pen 435, which is printing onto a rotational media 400. The height or swath of the printhead 435 corresponds to the length of the chord 485 of the sector. After each sector is printed, the rotational media 400 is rotated, about an axis extending away from the surface, by the spindle 410 by an angle equal to the angle subtended by the next sector to be printed. Where all sector angles are equal, then the rotation of the rotational media between print sweeps will be the same each time.

If the length of the chord 485 of the sector 480 is larger than the swath of the printhead 435, then not all of the sector 480 can be printed by the printhead 435 as it passes over the rotational media 400. Therefore, the length of the chord 485 of the sector 480 must be less than or equal to the swath of the printhead 435. If the length of the chord 485 of the sector 480 is less than the swath of the printhead 435, then all of the sector will be printed, but more passes of the printhead 435 over the rotational media 400 will be required, as more sectors must then be printed. Accordingly, the processing for preparing the image for such printing may be as described with reference to FIG. 3*b* above.

Figure 4B:
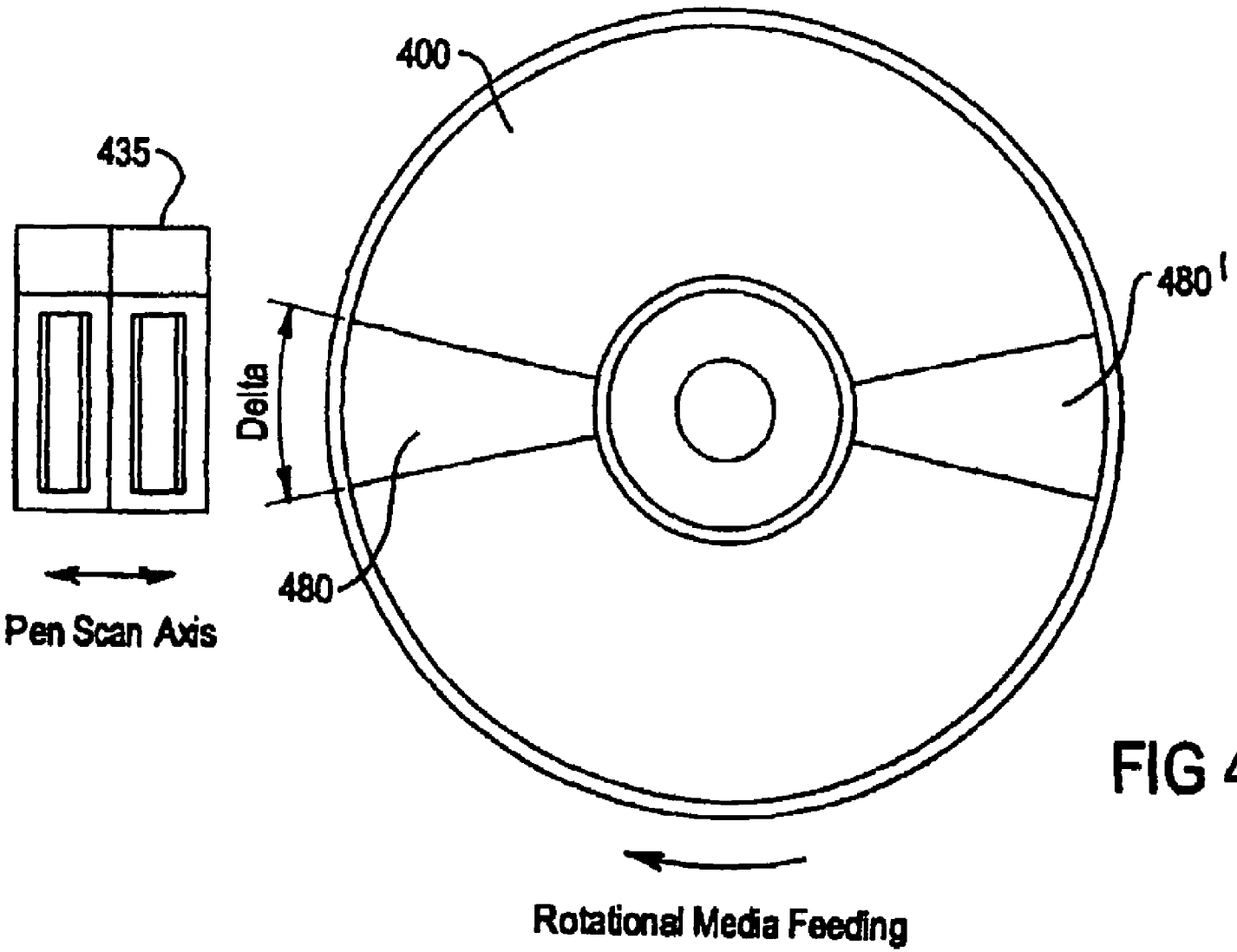
FIG. 4*b* shows a plan view of a rotational media being printed on according to an embodiment of the invention following the flow diagram of FIG. 3*c;*

FIG. 4*b* shows a surface of a rotational media to be printed on, where a diametrically opposed pair of sectors 480, 480' of the surface of the media 400 have already received a part of the image to be applied, according to an embodiment. The actual printing is similar to that described in relation to FIG. 4*a*. Two diametrically opposed sectors are printed to the rotational media together in this embodiment during each sweep of the printhead 435.

Figure 5A:
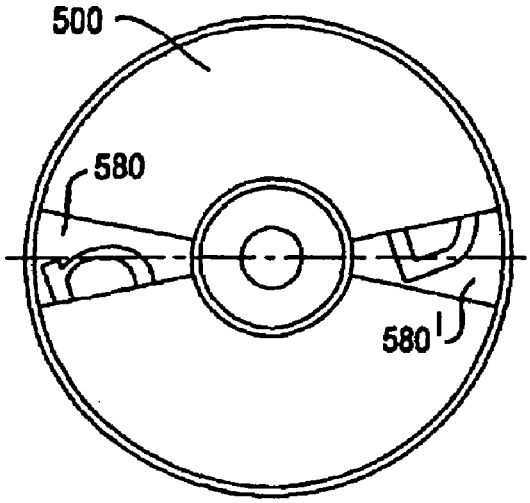
FIGS. 5*a*, 5*b*, and 5*c* show the effect of multiple print swaths on a rotational media, according to an embodiment of the invention following the flow diagram of FIG. 3*c;*
Figure 5B:
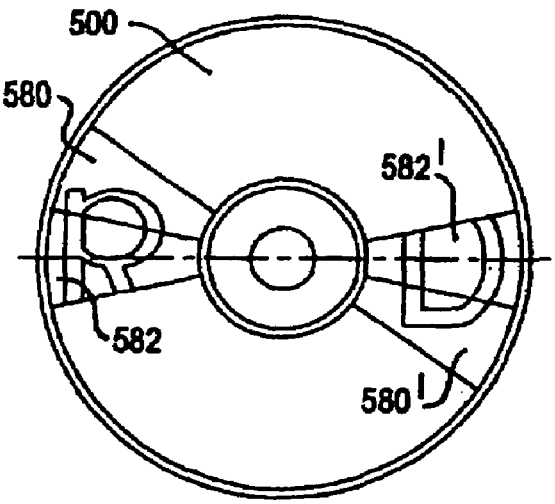
Figure 5C:
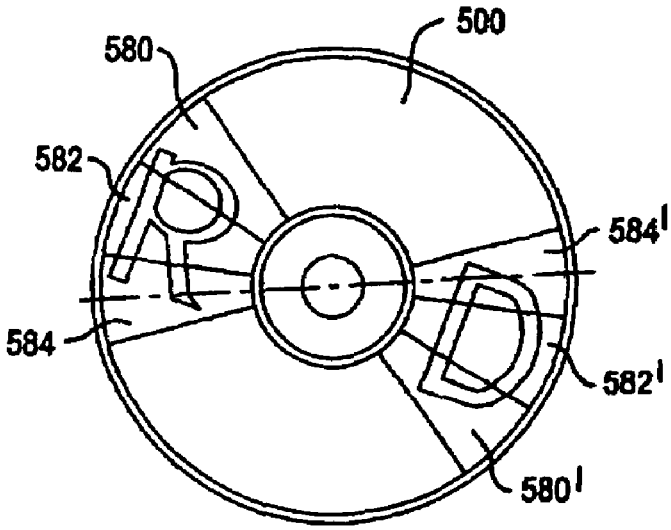

FIGS. 5*a, b* and *c* show consecutive print swaths on a surface of a rotational media. In FIG. 5*a*, a single swath has been printed, printing two diametrically opposed sectors 580, 580' of the image onto the surface of the rotational media 500. In FIG. 5*b*, the rotational media 500 has been rotated through an angle corresponding to the angle subtended by the sectors, and a further pair of diametrically opposed sectors 582, 582' have been printed, the second pair of sectors 582, 582' being printed directly next to the first set of sectors 580, 580'. In FIG. 5*c*, the rotational media has been rotated again, by the same angle once more, and a third pair of diametrically opposed sectors 584, 584' have been printed. The third pair of sectors 584, 584' has been printed directly next to the second pair of sectors 582, 582'. The three pairs of sectors together create an image. In this case, the image does not extend all the rotational media, and so the printing can be halted when not all the media has been printed to. However, for images that cover the whole surface of the media 500, all sectors in a complete rotation are printed. In this case, the media need not be rotated by a full 360° (2π Radians) because it does not have to be rotated back into position for the first printing sweep by the printhead.

In this way, the printing time can be reduced, as the number of rotations of the rotational media 500 during printing is reduced. The processing for preparing the image for such printing may be as described with reference to FIG. 3*c* above.

Figure 5D:
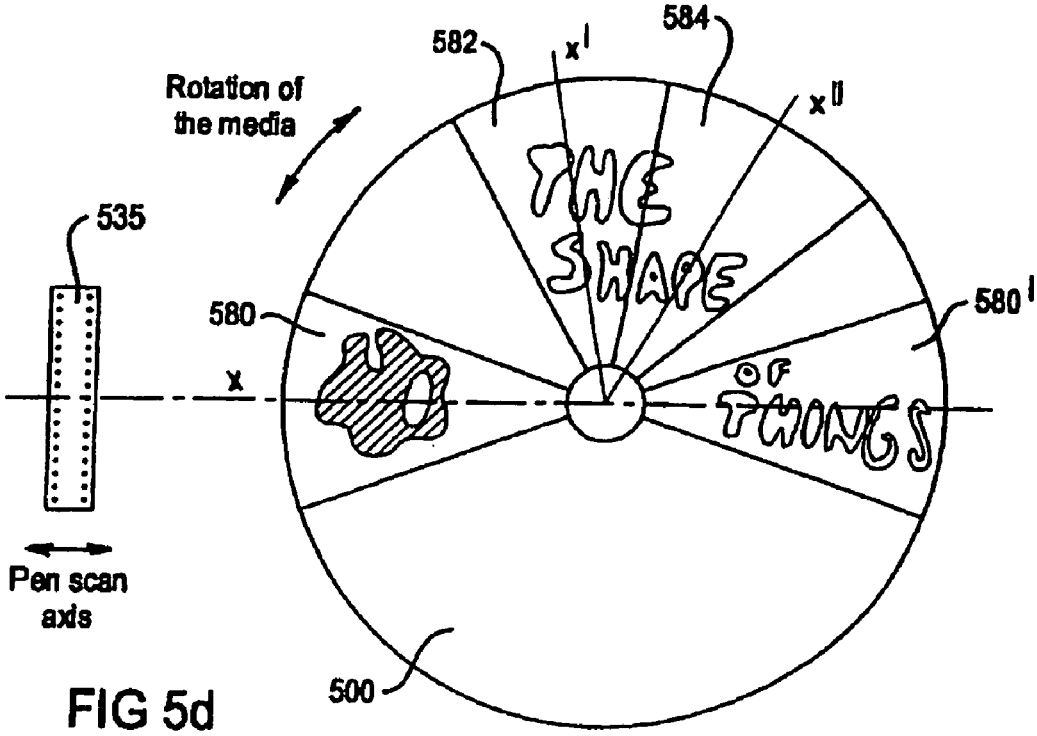
FIG. 5*d* shows partial image data to be printed with the least amount of total rotation, according to an embodiment of the invention following the flow diagram of FIG. 3*d*.

An embodiment, corresponding to the processing shown in FIG. 3*d* is shown in FIG. 5*d*. Selective sector printing by implementing two rotations to print the all image data is shown. The initial position prints diametrically opposed first sectors 580 and 580', followed by a clockwise rotation of the media for the X" axis to the pen 535 scan axis position to print the third sector 584, followed by a final clockwise rotation of the media for the X' axis to the pen 535 scan axis position to print the second sector 582. The figure shows that the direction of rotation may be either clockwise or counter-clockwise. This allows a reduction of the total angle of rotation used to print all image data, and reduces the total time to perform the printing. Thus, the initial direction of rotation is set to the least angle of rotation, considering a possible rotation in either direction, and subsequent rotations will correspondingly advance in the direction of least angle of rotation. Additionally, if the pen was initially on the right side of the rotational media 500, then after the first print sweep from right side to the left side, the next closest rotation would be counter-clockwise for the X' axis to the pen 535 scan axis position to print the second sector 582, followed by another counter-clockwise rotation to axis X" to print the third sector 584.

Figure 6A:
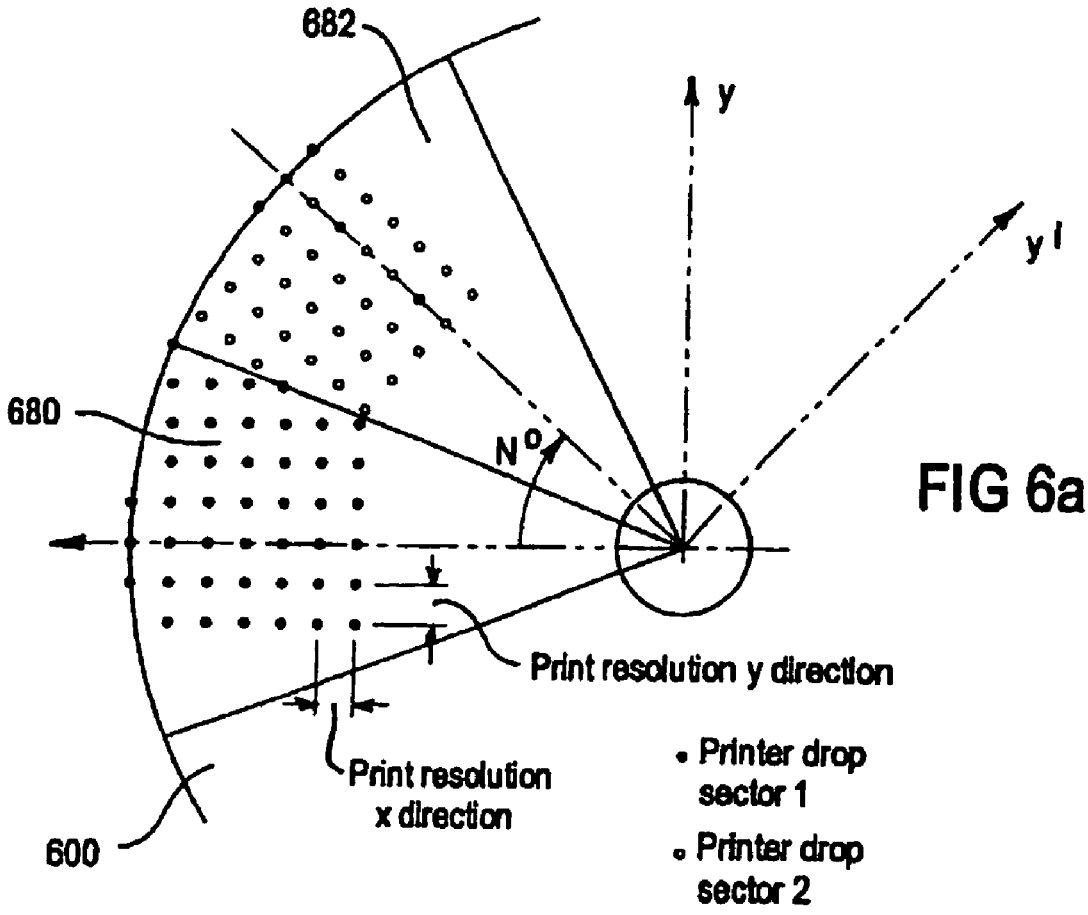
FIGS. 6*a* and 6*b* show cases of adjacent sector interlacing of data, for cases of binary and multi-level halftoning according to embodiments of the invention.

For adjacent sectors, the resultant printing of two rotationally offset rectangular grids means that there will be a zone of discontinuity of print grids. In order to minimize the visual impact, interlacing of print data is utilized to minimize fluctuations of print grid density. FIG. 6*a* shows one sample method of interlacing the data for a case of binary halftoning. A first sector 680 and a second sector 682 are shown. The first and second sectors 680, 682 are adjacent to one another on the media 600. The first sector 680 print grid locations will either allow, or not allow printing based on checking each grid location to be on or within the first sector 680 boundaries. For the second sector 682 grid locations, the testing of each possible second sector 682 print location for a combination of keeping on or within second sector 682 boundaries, and avoiding overlapping of first sector 680 print locations, and the testing of each possible grid location for a consistent density of print locations. Therefore, the second sector 682 print data includes some print data entering the first sector 680 area.

Figure 6B:
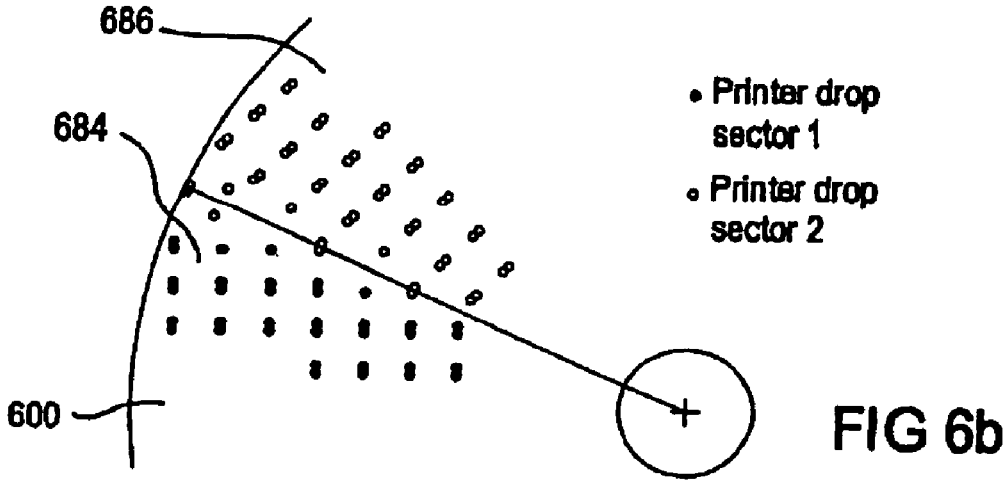

Similarly, FIG. 6*b* shows one sample method of interlacing the data for a case of multi-level halftoning. A third sector 684, and a fourth sector 686 are shown on the media 600 adjacent one another. In this case, additional consideration is made to interlace lower levels of halftoning to provide the illusion of an overall apparent consistency in printed output. Print data associated with the third sector 684 is allowed to be printed even where that data falls outside the third sector 684 print boundary, and similarly for the fourth print sector 686. When processing the data in order to prepare these sectors, the sectors are allowed to overlap, so that some data in the third sector is also in the fourth sector. The overlapping area is processed to ensure that the interlacing occurs correctly.

The present invention has been described above purely by way of example and alterations, omissions and modifications can be made, the invention extending to such modifications, omissions and alterations.

The present invention has been described above with the aid of functional building blocks illustrating the performance of specified functions and relationships thereof. The functional building blocks have been arbitrarily defined herein while describing embodiments of the invention. Alternate definitions can be defined so long as the specified functions and relationships thereof are maintained. The invention extends to any such alternate definitions. It will be seen that the functional building blocks can be implemented by application specific integrated circuits, discrete components, processors executing appropriate software and the like or any combination thereof.

What is claimed is:

1. A printer for printing an image onto a rotational media, the rotational media having a surface to be printed to and being rotatable about an axis extending away from the surface, said printer comprising:

a printhead configured to expel ink onto a media and to translate in a direction that is substantially parallel to the surface to be printed;

an engaging arrangement configured to engage a rotational media at a spaced distance from the printhead and to impart controlled rotation thereto relative to the printhead about the axis;

a processor; and a storage medium storing processor readable code, said code including instructions for processing image data and printing an image onto the rotational media, said instructions comprising:

i. dividing the image to be printed into a plurality of sectors, the center point of each sector being the center of the image, which corresponds to the center of the media;

ii. converting the pixel locations of each sector of the image into polar coordinates;

iii. rotating the polar coordinates for each converted sector by a predetermined angle;

iv. reconverting the pixel locations of each rotated sector into rasterized rectangular coordinates according to the rectangular coordinate system;

v. generating instructions to rotate the media by the same predetermined angle;

vi. generating instructions to print each sector onto the media using the reconverted data.

2. A printer according to claim 1, wherein the engaging arrangement comprises a spindle to grip a central portion of the rotational media and rotate the rotational media about the central portion.

3. A printer according to claim 2, wherein the spindle is arranged relative to the printhead such that the printhead can print the entire surface of the rotational media.

4. A printer according to claim 1 further comprising gearing for engaging a non-rotational media to be printed by the printhead, wherein the engaging arrangement is movable between a utility position in which the engaging arrangement can engage the rotational media in a position to be printed to by the printhead, and a retracted position in which the engagement arrangement does not interfere with printing on the non-rotational media by the printhead.

5. A printer according to claim 1, wherein said converting, rotating, and reconverting are applied to each pair of diametrically opposed sectors, and said instructions to print include instructions to print each pair of diametrically opposed sectors together.

6. A printer according to claim 1, wherein said rotational media is a compact disc.

* * * * *